US009223277B2

(12) United States Patent
Nakamoto et al.

(10) Patent No.: US 9,223,277 B2
(45) Date of Patent: Dec. 29, 2015

(54) IMAGE FORMING APPARATUS FOR CONTROLLING AT LEAST ONE IMAGING DEVICE IF AN END OF A LIFE OF A PHOTOCONDUCTOR IS DETECTED

(71) Applicant: FUJI XEROX CO., LTD., Tokyo (JP)

(72) Inventors: Toshie Nakamoto, Kanagawa (JP); Yusuke Kitagawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/589,505

(22) Filed: Jan. 5, 2015

(65) Prior Publication Data

US 2015/0234335 A1 Aug. 20, 2015

(30) Foreign Application Priority Data

Feb. 14, 2014 (JP) ..... 2014-026429

(51) Int. Cl.
*G03G 15/00* (2006.01)

(52) U.S. Cl.
CPC ..... *G03G 15/5033* (2013.01)

(58) Field of Classification Search
CPC ..... G03G 15/5033; G03G 15/75
USPC ..... 399/26
See application file for complete search history.

(56) References Cited

U.S. PATENT DOCUMENTS 7,263,299 B2 * 8/2007 Nagamochi et al. ..... 399/26
8,472,818 B2 * 6/2013 Yamane et al. ..... 399/26
8,924,183 B2 * 12/2014 Zona et al. ..... 399/26

FOREIGN PATENT DOCUMENTS

JP 10-133542 A 5/1998
JP 1 1-21 2409 A 8/1999

* cited by examiner

*Primary Examiner* — William J Royer
(74) *Attorney, Agent, or Firm* — Sughrue Mion, PLLC

(57) ABSTRACT

An image forming apparatus includes at least one imaging device including at least a photoconductor, a charging device, an exposure device, a developing device, and a transfer device; a detector that detects that the photoconductor of the at least one imaging device has reached the end of a life of the photoconductor; and a controller that controls the at least one imaging device under an imaging condition including a charge condition, an exposure condition, a development condition, and a transfer condition. After the controller acquires detection information of the detector, the controller controls the at least one imaging device by changing the imaging condition to a condition that decreases an image quality.

4 Claims, 7 Drawing Sheets

FIG. 7

| | | POLARITY | | POLARITY | |
|---|---|---|---|---|---|
| BASIC CONFIGURATION OF POTENTIAL ETC. | CHARGE POTENTIAL | MINUS | MINUS | PLUS | PLUS |
| | DEVELOPMENT POTENTIAL | MINUS | MINUS | PLUS | PLUS |
| | LATENT IMAGE POTENTIAL | MINUS | MINUS | PLUS | PLUS |
| | CHARGE POLARITY OF TONER | MINUS | PLUS | MINUS | PLUS |
| CHANGE CONDITION THAT DECREASES IMAGE QUALITY AND IMAGE QUALITY CONTENT UNDER EACH CONDITION | CONDITION THAT NARROWS POTENTIAL DIFFERENCE Va | GENERATION OF FOG | LOW DENSITY | LOW DENSITY | GENERATION OF FOG |
| | CONDITION THAT NARROWS POTENTIAL DIFFERENCE Vc | LOW DENSITY | GENERATION OF FOG | GENERATION OF FOG | LOW DENSITY |

IMAGE FORMING APPARATUS FOR CONTROLLING AT LEAST ONE IMAGING DEVICE IF AN END OF A LIFE OF A PHOTOCONDUCTOR IS DETECTED

CROSS-REFERENCE TO RELATED APPLICATIONS

This application is based on and claims priority under 35 USC 119 from Japanese Patent Application No. 2014-026429 filed Feb. 14, 2014.

BACKGROUND

The invention relates to an image forming apparatus.

SUMMARY

According to an aspect of the invention, there is provided an image forming apparatus including at least one imaging device including at least a photoconductor, a charging device, an exposure device, a developing device, and a transfer device; a detector that detects that the photoconductor of the at least one imaging device has reached the end of a life of the photoconductor; and a controller that controls the at least one imaging device under an imaging condition including a charge condition, an exposure condition, a development condition, and a transfer condition. After the controller acquires detection information of the detector, the controller controls the at least one imaging device by changing the imaging condition to a condition that decreases an image quality.

BRIEF DESCRIPTION OF THE DRAWINGS

Exemplary embodiments of the present invention will be described in detail based on the following figures, wherein:

FIG. 7 is a table showing the relationship between the basic configuration relating to polarities of respective potentials and the condition contents that decrease the image quality.

DETAILED DESCRIPTION

Exemplary embodiments for implementing the invention (hereinafter, merely referred to as "exemplary embodiments") are described below with reference to the accompanying drawings.

First Exemplary Embodiment

Figure 1:
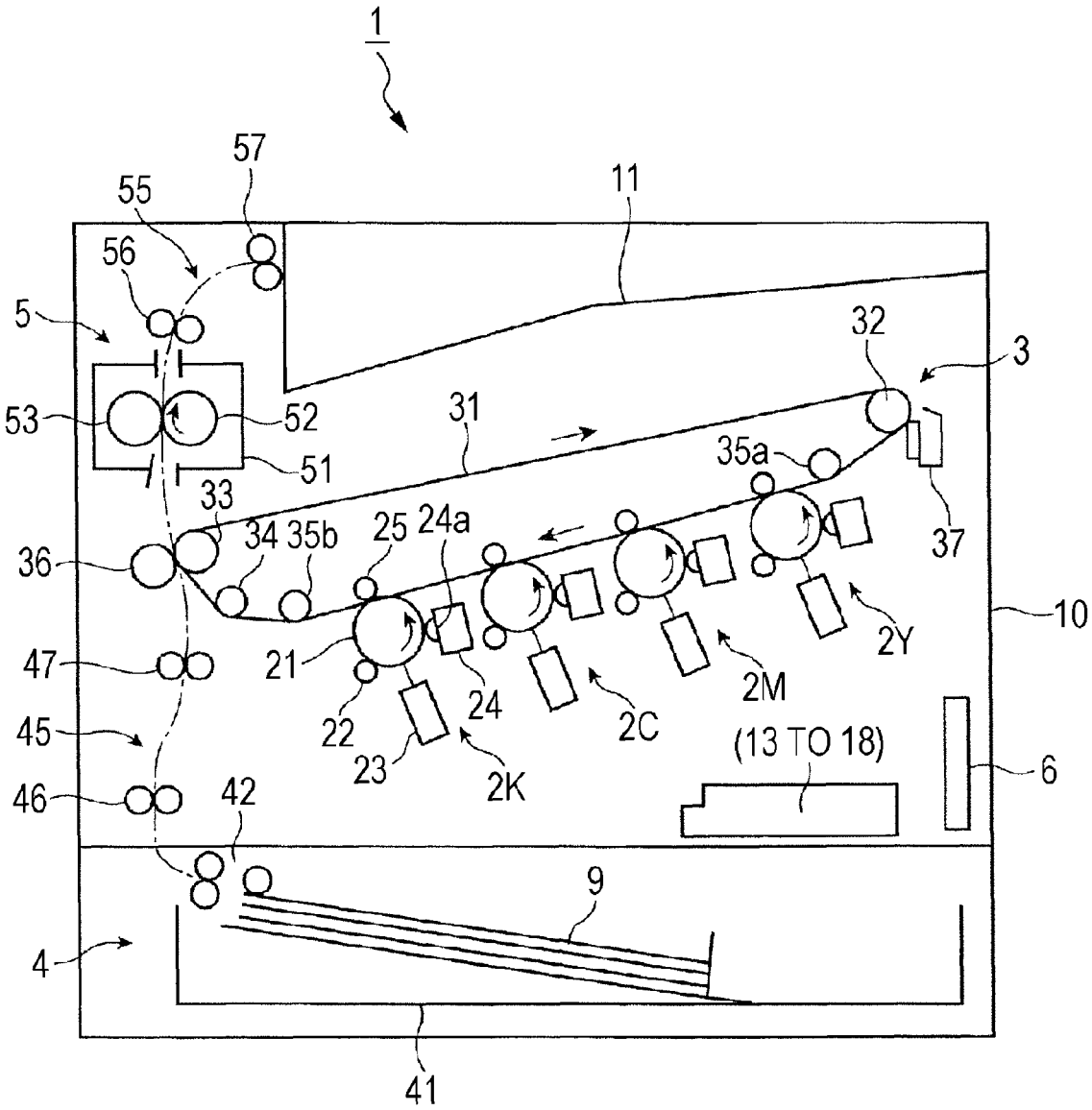
FIG. 1 is a general illustration briefly showing a configuration of an image forming apparatus according to a first exemplary embodiment.
Figure 2:
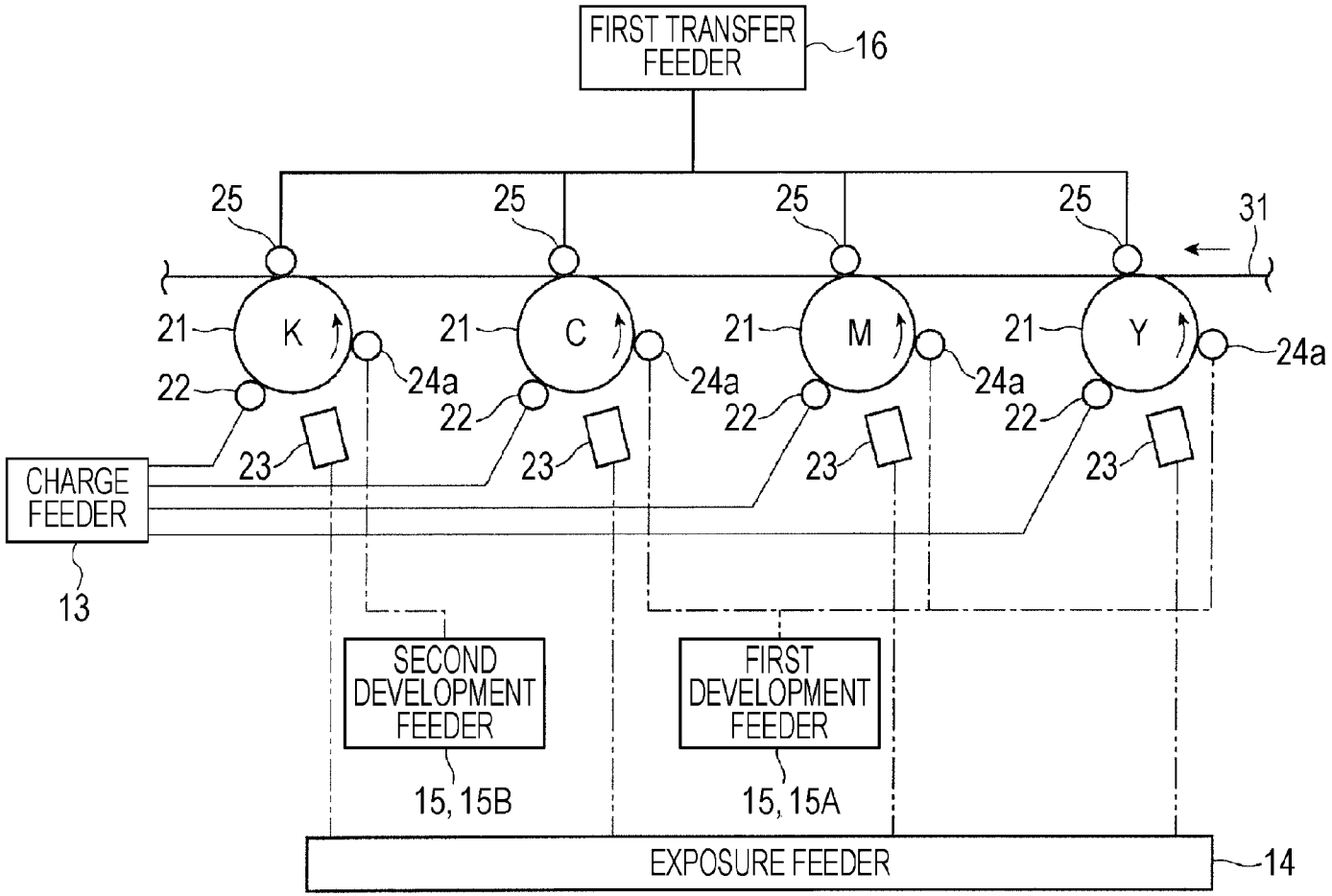
FIG. 2 is a conceptual diagram schematically showing a configuration portion that feeds electric power to respective imaging devices in the image forming apparatus in FIG. 1.
Figure 3:
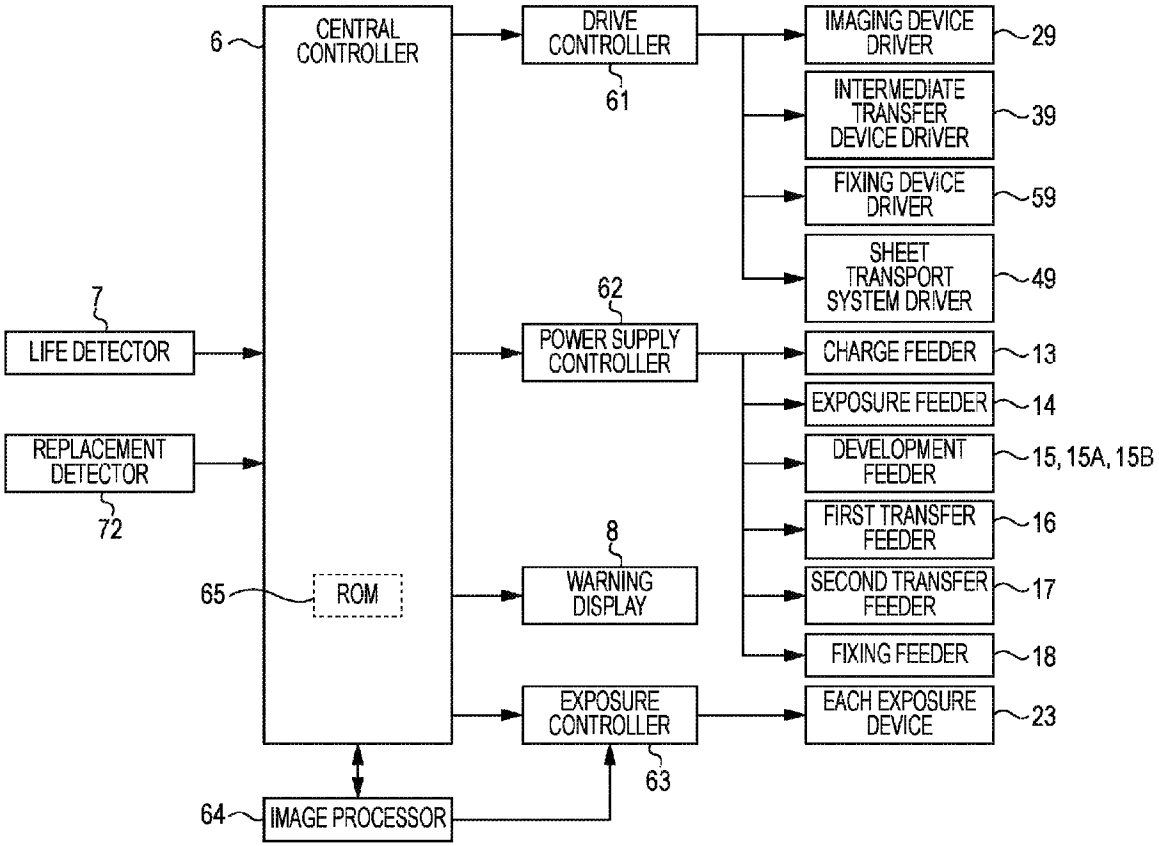
FIG. 3 is a block diagram showing a major configuration portion relating to a controller in the image forming apparatus in FIG. 1.

FIG. 1 briefly illustrates a configuration of an image forming apparatus according to a first exemplary embodiment, FIG. 2 briefly illustrates a configuration portion that feeds electric power to respective imaging devices in the image forming apparatus, and FIG. 3 illustrates a major configuration portion relating to a controller in the image forming apparatus.

An image forming apparatus 1 according to the first exemplary embodiment includes, in the inner space of a housing 10, plural imaging devices 2 (Y, M, C, K) that form toner images developed with toners serving as developers in accordance with input image information, an intermediate transfer device 3 that holds the toner images formed by the imaging devices 2 (Y, M, C, K) and finally transfer the toner images on a recording sheet 9 serving as a recording material, a sheet feeding device 4 that houses and feeds a predetermined recording sheet 9, which is to be transported to a second transfer position of the intermediate transfer device 3, and a fixing device 5 that allows the recording sheet 9 having the toner images transferred thereon by the intermediate transfer device 3 to pass therethrough and fixes the toner images. Reference sign 6 in FIG. 1 indicates a central controller that entirely controls operations of respective configuration portions of the image forming apparatus 1. Reference sign 11 indicates an output housing portion that is formed in an inclined surface shape at an upper surface of the housing 10, and houses the recording sheet 9 after image formation. Also, a dotted-chain line in FIG. 1 indicates a major transport path when the recording sheet 9 is transported.

The plural imaging devices 2 (Y, M, C, K) include four imaging devices 2Y, 2M, 2C, and 2K that respectively form toner images of four colors including yellow (Y), magenta (M), cyan (C), and black (K). The imaging devices 2 (Y, M, C, K) are arranged in series at predetermined intervals (for example, the same intervals), in an inclined manner toward the lower left side in the drawing in order of the above-listed four colors. Also, the four imaging devices 2 (Y, M, C, K) each include a photoconductor drum 21, a charging device 22, an exposure device 23, a developing device 24, and a first transfer device 25. Further, the four imaging devices 2 (Y, M, C, K) are each formed as a process cartridge (removably mounted unit) in which the photoconductor drum 21 and the charging device 22 are integrally formed. The process cartridge may be freely removably mounted on (a mount portion of) the housing 10 and may be used.

The photoconductor drum 21 has an image holding surface with a photoconductive layer (photosensitive layer) made of an organic photosensitive material or the like formed on the peripheral surface of a cylindrical or columnar conductive base member being grounded. The photoconductor drum 21 receives a power from a not-illustrated rotational driving device (imaging device driver 29) and rotates in a direction indicated by an arrow. The charging device 22 is a contact charging device that electrically charges the image holding surface of the photoconductor drum 21 with a predetermined charge potential. A charge voltage is applied from a charge feeder 13 to a contact member arranged in contact with the image holding surface. If the developing device 24 executes reversal development, a charge voltage with the same polarity as the charge polarity of the toner supplied from the developing device 24 is fed.

The exposure device 23 forms an electrostatic latent image made of a predetermined latent image potential by irradiating the charged image holding surface of the photoconductor drum 21 with light which is separated into the four color components in accordance with the image information input to the image forming apparatus 1. The exposure device 23 uses a non-scanning exposure device including a light-emitting diode, an optical component, and the like. Also, the exposure device 23 receives an input of an image signal for forming a latent image from an image processor 64 that executes predetermined processing in accordance with the image information input to the image forming apparatus 1 from an external connection device such as a personal computer terminal.

The developing device 24 has a developer container that houses a two-component developer (developer containing non-magnetic toner and magnetic carrier) which is an example of the developer. The developing device 24 has a development roller 24*a* that holds the developer housed in the developer container while rotating and transports the developer to a development region being close to and facing the photoconductor drum 21, a steering transport member that transports the housed two-component developer while rotating and stirring the developer to the development roller 24*a*, and a layer thickness restriction member that restricts the amount of developer (layer thickness) held on the development roller 24*a*. Also, in the developing device 24, a development voltage is fed from a development feeder 15 to the development roller 24*a*, and the development roller 24*a* and the stirring transport member receive a power from the not-illustrated rotational driving device (imaging device driver 29) and rotate in predetermined directions. As the development voltage, for example, direct current with alternating current superposed thereon is fed. The toner of the developer is rubbed with the carrier when being stirred by the stirring transport member in the developer container and hence is charged with a friction charge with a predetermined polarity (in this exemplary embodiment, minus polarity).

The first transfer device 25 is a contact transfer device including a contact member which rotates while being in contact with the image holding surface of the photoconductor drum 21 after the development (in a state with an intermediate transfer belt 31 interposed), and which is fed with a first transfer voltage from a first transfer feeder 16. The contact member is a first transfer roller that is rotated by the rotation of the photoconductor drum 21 while pressing an the intermediate transfer belt 31 (described later) to the image holding surface of the photoconductor drum 21. As the first transfer voltage, a direct-current voltage (direct-current voltage with the reverse polarity to the charge polarity of the toner) is fed.

The intermediate transfer device 3 is arranged to be located above the four imaging devices 2 (Y, M, C, K). The intermediate transfer device 3 includes the intermediate transfer belt 31 that rotates in a direction indicated by an arrow while passing through a first transfer position located between the photoconductor drum 21 and the first transfer device 25 (contact member) in each of the imaging devices 2 (Y, M, C, K); plural support rollers 32, 33, 34, 35*a*, and 35*b* that hold the intermediate transfer belt 31 in a desirable state from the inner side and supports the intermediate transfer belt 31 rotatably; a second transfer roller 36 that contacts the intermediate transfer belt 31 supported by the support roller 33 with a predetermined pressure and rotates; and a belt cleaning device 37 that removes the toner and the like remaining on and adhering to the intermediate transfer belt 31 after the intermediate transfer belt 31 passes through the second transfer roller 36.

The intermediate transfer belt 31 uses a material in which a resistance controller such as carbon is dispersed into synthetic resin, such as polyimide resin or polyamide resin, and is formed in a substantially ring-shaped belt with a predetermined thickness. The support roller 32 serves as a driving roller, the support roller 33 serves as a backup roller for second transfer, the support roller 34 serves as a tension applying roller, and support rollers 35*a* and 35*b* serve as transfer-surface shaping rollers. The support roller 32 serving as the driving roller receives a power from a not-illustrated rotational driving device (intermediate transfer device driver 39) and is rotated in a predetermined direction. The support roller 33 or the second transfer roller 36 is fed with a second transfer voltage from a second transfer feeder 17. As the second transfer voltage, a direct-current voltage with the same polarity as the charge polarity of the toner is fed when being fed to the support roller 33, and a direct-current component with the reverse polarity to the charge polarity of the toner is fed when being fed to the second transfer roller 36.

The sheet feeding device 4 is arranged below the intermediate transfer device 3. The sheet feeding device 4 includes a single housing body 41 or plural housing bodies 41 each of which is attached so that the sheet feeding device 4 may be pulled out to the side of the front surface of the housing 10 (side surface facing a user during operation) and houses recording sheets 9 of predetermined size and a predetermined type in a stacked manner, and a sending device 42 that sends out the recording sheets 9 from the housing body 41 one by one. Reference sign 45 in FIG. 1 indicates a sheet-feed transport path for transporting the recording sheet 9 sent out from the sheet feeding device 4 to the second transfer position of the intermediate transfer device 3 (between the intermediate transfer belt 31 and the second transfer roller 36). The sheet-feed transport path 45 includes plural transport roller pairs 46, 47, . . . , and a transport guide member (not shown). The transport roller pair 47 is formed as a sending roller pair having, for example, a function of correcting the transport timing and the transport state of the recording sheet 9. The sending device 42 and the respective transport roller pairs receive a power from a not-illustrated rotational driving device (sheet transport system driver 49) and are rotated in respective predetermined directions.

The fixing device 5 is arranged at a space position above the second transfer roller 36 of the intermediate transfer device 3. The fixing device 5 includes, in a housing 51, a heat rotary member 52 in a roller form, a belt form, or the like that is rotated in a direction indicated by an arrow and heated by a heater so that its surface temperature is held at a predetermined temperature, and a pressure rotary member 53 in a roller form, a belt form, or the like that contacts the heat rotary member 52 substantially along the axial direction of the heat rotary member 52 and is rotated by the rotation of the heat rotary member 52. The heater of the heat rotary member 52 is fed with a predetermined heat voltage from a fixing feeder 18. The heat rotary member 52 receives a power from a not-illustrated rotational driving device (fixing device driver 59) and is rotated in a predetermined direction. Reference sign 55 in FIG. 1 indicates a sheet-output transport path for transporting the recoding sheet 9 after fixing to be output to the output housing portion 11. The sheet-output transport path 55 includes plural transport roller pairs 56 and 57, and a transport guide member (not shown).

The central controller 6 includes memories having a read-only memory (ROM) 65 shown in FIG. 3 and an external memory; an arithmetic processing device (not shown), an input/output device (not shown), and a controller (not shown). The central controller 6 executes a control operation in accordance with the contents of program, data, and the like, stored in the memories.

As shown in FIG. 3, the central controller 6 is connected with a life detector 7 that detects that the photoconductor drum 21 in each imaging device 2 (Y, M, C, K) has reached the end of its predetermined life, a replacement detector 72 that detects that the process cartridge has been replaced with a new one, an input operation unit (not shown), and other detector such as any of various sensors. Various pieces of detection information and input information are input from the respective units.

Also, the central controller 6 is connected with the image processor 64 that executes predetermined processing in accordance with image information input from an external connection device connected with the image forming apparatus 1; a drive controller 61 that controls an operation of a driving part in the image forming apparatus 1; a power supply controller 62 that controls an operation of a power supply in the image forming apparatus 1; an exposure controller 63 that controls an operation of the exposure device 23 in each imaging device 2 (Y, M, C, K) in response to an image signal from the image processor 64; and a warning display 8 that provides displaying of a warning; and the like. The central controller 6 sends required control signals respectively to the controllers.

The drive controller 61 is connected with, for example, the image device driver 29 of each imaging device 2 (Y, M, C, K), the intermediate transfer device driver 39 of the intermediate transfer device 3, the fixing device driver 59 of the fixing device 5, and the sheet transport system driver 49 of the sheet feeding device 4, the sheet-feed transport path 45, and the like, and controls the operations of the respective drivers. The power supply controller 62 is connected with the charge feeder 13, an exposure feeder 14, the development feeder 15 (15A, 15B), the first transfer feeder 16, the second transfer feeder 17, the fixing feeder 18, and the like, and controls the operations of the respective feeders. Describing the development feeder 15 among these feeders, a first development feeder 15A feeds a common (the same) development voltage to the development rollers 24*a* of the respective developing devices 24 included in the three imaging devices 2 (Y, M, C), a second development feeder 15B additionally feeds a development voltage to the development roller 24*a* included in the imaging device 2K. Also, the first transfer feeder 16 feeds a common (the same) first transfer voltage to the first transfer rollers of the respective first transfer devices 25 included in the four imaging devices 2 (Y, M, C, K).

Also, when the life detector 7 detects one or both of a situation that the cumulative number of rotations of the photoconductor drum 21 in each of the imaging devices 2 (Y, M, C, K) has reached its threshold and a situation that a value of the film thickness of the photoconductor drum 21 predicted with reference information, such as a setting environment condition (temperature, humidity) or a charge time, has reached its threshold, the life detector 7 judges that the photoconductor drum 21, which is a subject of the detection result, has reached the end of its life, and transmits detection information at this time to the central controller 6. The judgment whether or not the photoconductor drum 21 has reached the end of its life may be made by the central controller 6 (the central controller 6 may execute processing for judging whether or not each detection value has reached a threshold).

Further, the replacement detector 72 reads unique identification information provided in the form of, for example, a non-volatile memory or a shape at the process cartridge portion of each of the four imaging devices 2 (Y, M, C, K), at the body side of the image forming apparatus 1, and manages and judges the identification information, to detect which one of the process cartridges is replaced with a new one, such as a new product, when the identification information is changed in midstream. Also, the warning display 8 is, for example, a liquid crystal screen panel that may display a warning message.

The central controller 6 in the image forming apparatus 1 provides control to basically hold an imaging condition of each of the four imaging devices 2 (Y, M, C, K) in a good image quality state, the imaging condition including a charge condition (for example, value of charge voltage), an exposure condition (for example, value of latent image potential formed by exposure with light), a development condition (for example, value of development voltage), and a first transfer condition (for example, value of first transfer voltage). The imaging conditions of the respective imaging devices 2 (Y, M, C, K) are actually controlled by the power supply controller 62. Also, regarding the imaging condition, an imaging condition of initial setting is applied at the beginning of use of the image forming apparatus 1. However, thereafter, an imaging condition corrected for holding the image quality in accordance with factors, such as a setting environment condition and a cumulative time of use is applied.

Also, the central controller 6 in the image forming apparatus 1 is set to execute a control operation (FIG. 4, described later) when the central controller 6 acquires detection information of the life detector 7 (information indicative of detection about that the photoconductor drum 21 has reached the end of its life). The overview of the control operation is as follows. When the detection information of the life detector 7 is acquired, the imaging condition of the imaging device 2 (Y, M, C, K) (one or some of 2Y, 2M, 2C, and 2K) including the photoconductor drum 21 detected as being at the end of its life is changed to a condition that decreases the image quality, and the relevant imaging device 2 (Y, M, C, K) is controlled under the changed imaging condition.

Also, the image forming apparatus 1 has at least an imaging pattern (full-color mode) for forming a full-color image with four-color (Y, M, C, K) toner images by using all the four imaging devices 2 (Y, M, C, K), and an imaging pattern (monochrome mode) for forming a monochrome image with a single-color toner image by using one of the four imaging devices 2 (Y, M, C, K). The monochrome mode according to the first exemplary embodiment is set as a black and white mode for forming a black and white image with a toner image of black (K).

A basic image forming operation using the image forming apparatus 1 is described below.

In this case, an operation when a full-color image in the full-color mode is formed is described as an example.

First, during image formation in the full-color mode, in the four imaging devices 2 (Y, M, C, K), the photoconductor drums 21 are rotated in the directions indicated by arrows, and the charging devices 22 charge the image holding surfaces of the photoconductor drums 21 with a predetermined polarity (in the first exemplary embodiment, minus polarity) and a potential corresponding to the charge voltage. Then, the exposure devices 23 of the imaging devices 2 (Y, M, C, K) expose the charged photoconductor drums 21 with light in accordance with image signals separated into the respective color components (Y, M, C, K), to form electrostatic latent images of the respective color components with the predetermined potential on the image holding surfaces of the photoconductor drums 21.

Then, the developing devices 24 of the imaging devices (Y, M, C, K) supply the toners of the respective colors (Y, M, C, K) charged with the predetermined polarity (minus polarity) from the development rollers 24*a* to the electrostatic latent image portions of the respective color components formed on the photoconductor drums 21. The toners electrostatically adhere to the electrostatic latent image portions because of a development electric field including the development voltage. Accordingly, toner images of the four colors (Y, M, C, K) are respectively formed on the image holding surfaces of the photoconductor drums 21 in the imaging devices 2 (Y, M, C, K). That is, for example, a toner image of yellow is formed on the photoconductor drum 21 of the imaging device 2Y, and a toner image of magenta is formed on the photoconductor drum 21 of the imaging device 2M.

Then, the toner images of the four colors respectively formed on the photoconductor drums 21 of the imaging devices 2 (Y, M, C, K) are successively (in order of Y, M, C, and K) first-transferred on the intermediate transfer belt 31 of the intermediate transfer device 3 because of a transfer electric field formed by the first transfer devices 25 with the first transfer voltage at the first transfer positions, and the toner images are superposed. Then, after the intermediate transfer device 3 transports the toner images first-transferred on the intermediate transfer belt 31 to the second transfer position by rotating the toner images in the direction indicated by arrow of the intermediate transfer belt 31, the toner images are collectively second-transferred on a recording sheet 9, which is transported from the sheet feeding device 4 through the sheet-feed transport path 45, because of a transfer electric field formed by the second transfer roller 36 (or the support roller 33) with the second transfer voltage at the second transfer position.

Then, the intermediate transfer device 3 removes the recording sheet 9 with the toner image second-transferred thereon from the intermediate transfer belt 31 and then sends the recording sheet 9 toward the fixing device 5. Then, in the fixing device 5, the recording sheet 9 with the toner image transferred thereon is transported through a contact part between the heat rotary member 52 and the pressure rotary member 53, and the toner image is heated and pressed. Accordingly, the toner image is molten and fixed to the recording sheet 9. Then, the fixing device 5 sends the recording sheet 9 after the toner image is fixed to the sheet-output transport path 55. In a case of image formation on one side of the recording sheet 9, the recording sheet 9 after the fixing passes through the sheet-output transport path 55, is output to the outside of the housing 10, and is finally housed in the output housing portion 11.

With the above-described operation, the single recording sheet 9 with the full-color image formed on one side thereof is output, the full-color image which is formed by combining the toner images of the four colors. The image forming operation in the full-color mode is ended.

In the case of the operation for forming a black and white image in the black and white mode, first, only the imaging device 2K of black among the four imaging devices 2 (Y, M, C, K) is actuated and a toner image of black is formed on the image holding surface of the photoconductor drum 21. Then, the toner image of black formed by the imaging device 2K is first-transferred on the intermediate transfer belt 31, is second-transferred on a recording sheet 9, and is finally fixed to the recording sheet 9 by the fixing device 5. Accordingly, the single recording sheet 9 having formed thereon the black and white image being the toner image of black is output, and the image forming operation in the black and white mode is ended.

Next, a control operation that is executed when the detection information is acquired from the life detector 7 in the image forming apparatus 1 is described.

Figure 4:
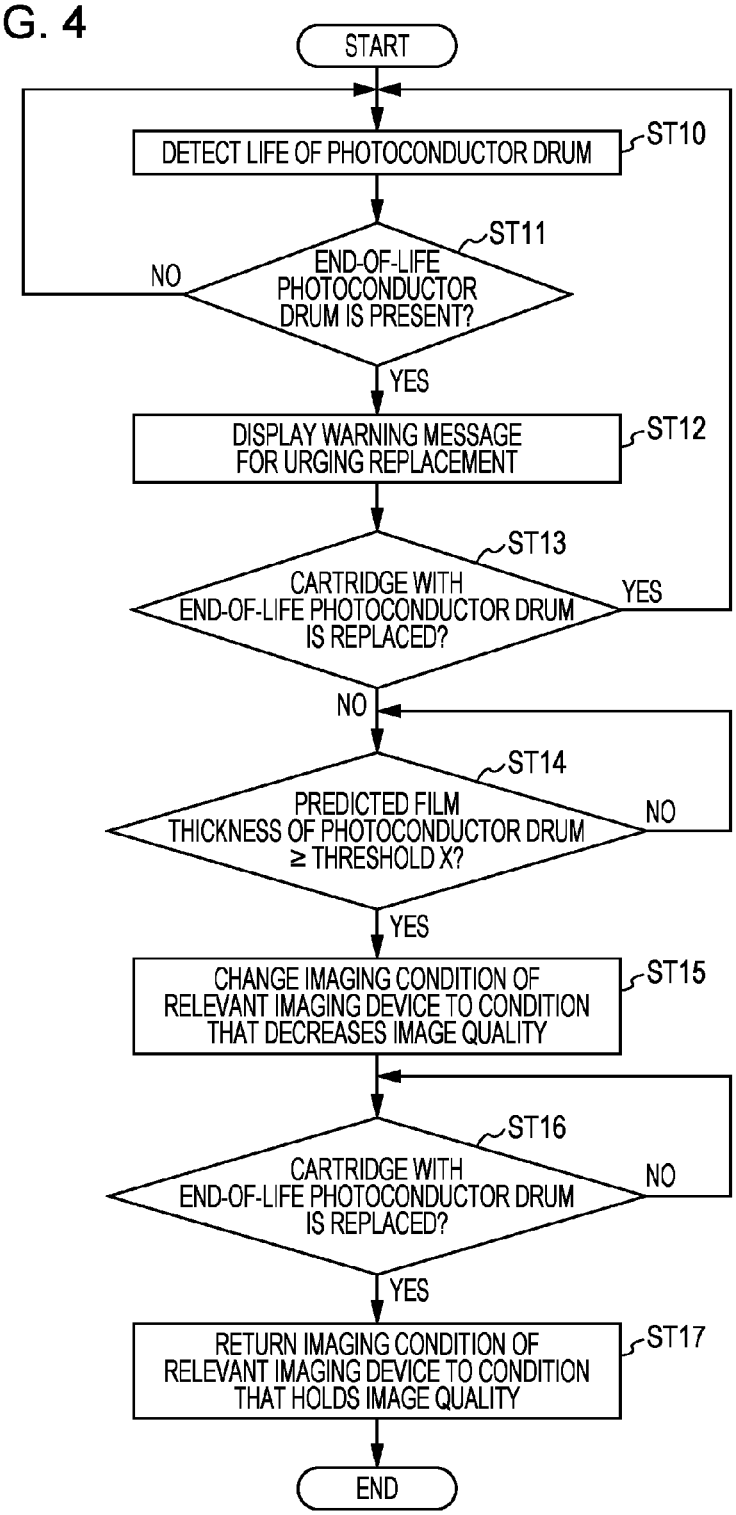
FIG. 4 is a flowchart showing a flow of a major control operation if it is detected that a photoconductor drum has reached the end of its life.

For example, when the image forming apparatus 1 reaches a predetermined timing, such as a timing at which the image forming operation is executed and a timing after an open/close operation of an open/close panel of the housing 10 is executed, as shown in FIG. 4, the life detector 7 detects whether the photoconductor drums 21 in the four imaging devices 2 (Y, M, C, K) each have reached the end of its life (step 10, hereinafter, abbreviated as "ST10," the other steps described later will be also abbreviated similarly). The life detector 7 detects that the cumulative number of rotations of each photoconductor drum 21 reaches its threshold, and that the predicted film thickness of the photoconductor drum 21 reaches its threshold.

The life detector 7 is continuously actuated until the life detector 7 detects that the photoconductor drum 21 has reached the end of its life (ST11), and then if the life detector 7 detects that the photoconductor drum 21 of any of the four imaging devices 2 (Y, M, C, K) has reached the end of its life, the life detector 7 transmits the detection information to the central controller 6. Then, the central controller 6 operates to cause the warning display 8 to display a warning message (for example, a message "replace process cartridge of  color") for urging replacement of the process cartridge of the imaging device 2 (Y, M, C, K) including the photoconductor drum 21 which has reached the end of its life (ST12**).

Then, the central controller 6 starts to detect whether or not the process cartridge of the imaging device 2 (Y, M, C, K) including the photoconductor drum 21 at the end of its life is replaced since the timing at which the warning message is displayed, depending on acquisition or non-acquisition of the detection information from the replacement detector 72 (ST13). At this time, the life detector 7 continuously acquires information about the cumulative number of rotations of each photoconductor drum 21 and the predicted film thickness of the photoconductor drum 21. Also, the life detector 7 starts to detect whether or not the value of the predicted film thickness of each photoconductor drum 21 reaches a previously set threshold X (threshold set to determine a start timing of the control that decreases the image quality, which will be described later).

In ST14, if replacement of the process cartridge of the imaging device 2 (Y, M, C, K) including the photoconductor drum 21 at the end of its life is detected (when the detection information is acquired from the replacement detector 72), the process returns to ST10, and the central controller 6 provides control to continuously execute the detection of the life of the photoconductor drum 21 in the process cartridge after the replacement.

In contrast, if the replacement of the process cartridge of the imaging device 2 (Y, M, C, K) including the photoconductor drum 21 at the end of its life is not detected in ST14 (when the detection information is not acquired from the replacement detector 72), and if it is detected that the value of the predicted film thickness of any of the photoconductor drums 21 has reached the threshold X (ST14), the central controller 6 changes only the imaging condition of the imaging device 2 (Y, M, C, K) including the photoconductor drum 21 at the end of its life to a condition that decreases the image quality (ST15). At this time, the central controller 6 is set to hold the state in which the image forming operation may be executed, without stopping the image forming apparatus 1 in execution or rejecting the image forming operation newly started (requested) next.

Figure 5:
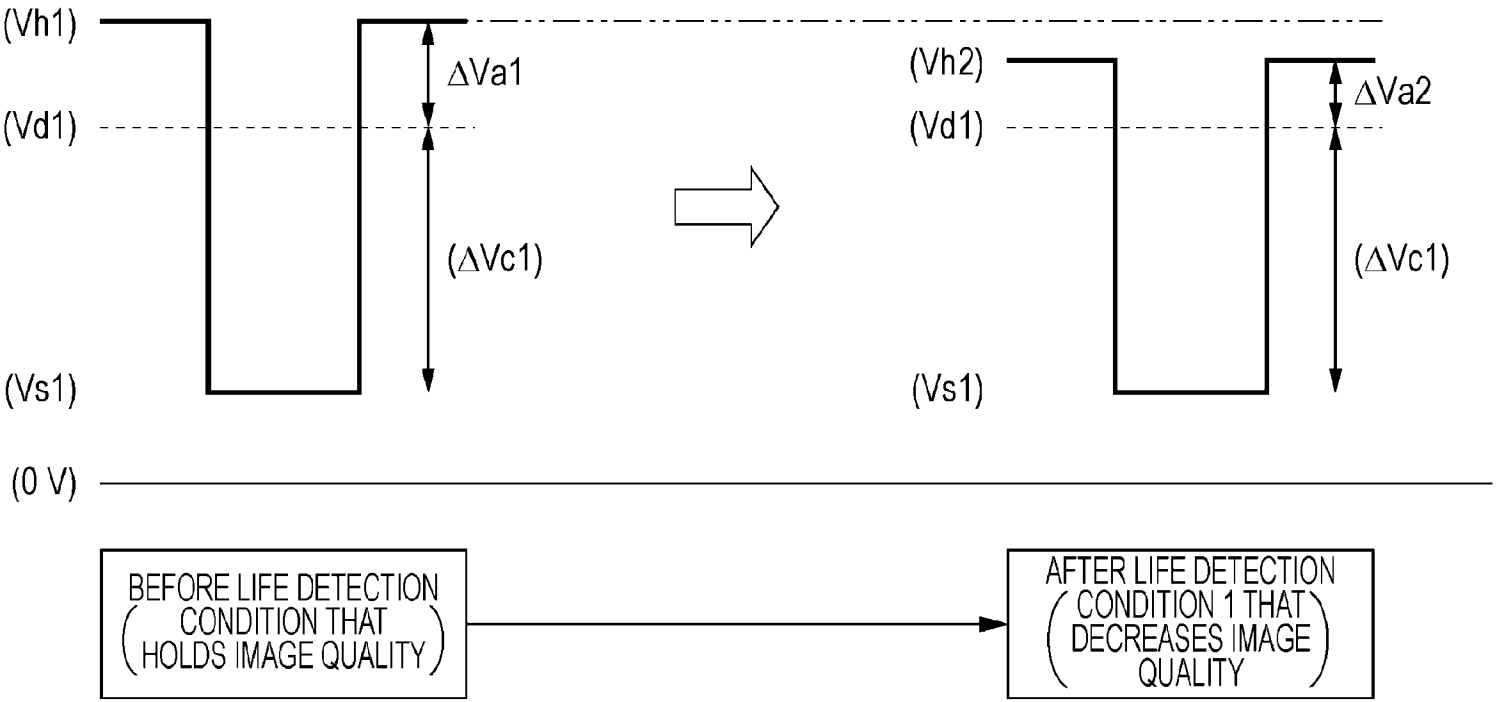
FIG. 5 is an explanatory view showing an example of an imaging condition before the detection of the life of the photoconductor drum and an imaging condition that decreases the image quality, the condition which is changed after the detection of the life.
Figure 6:
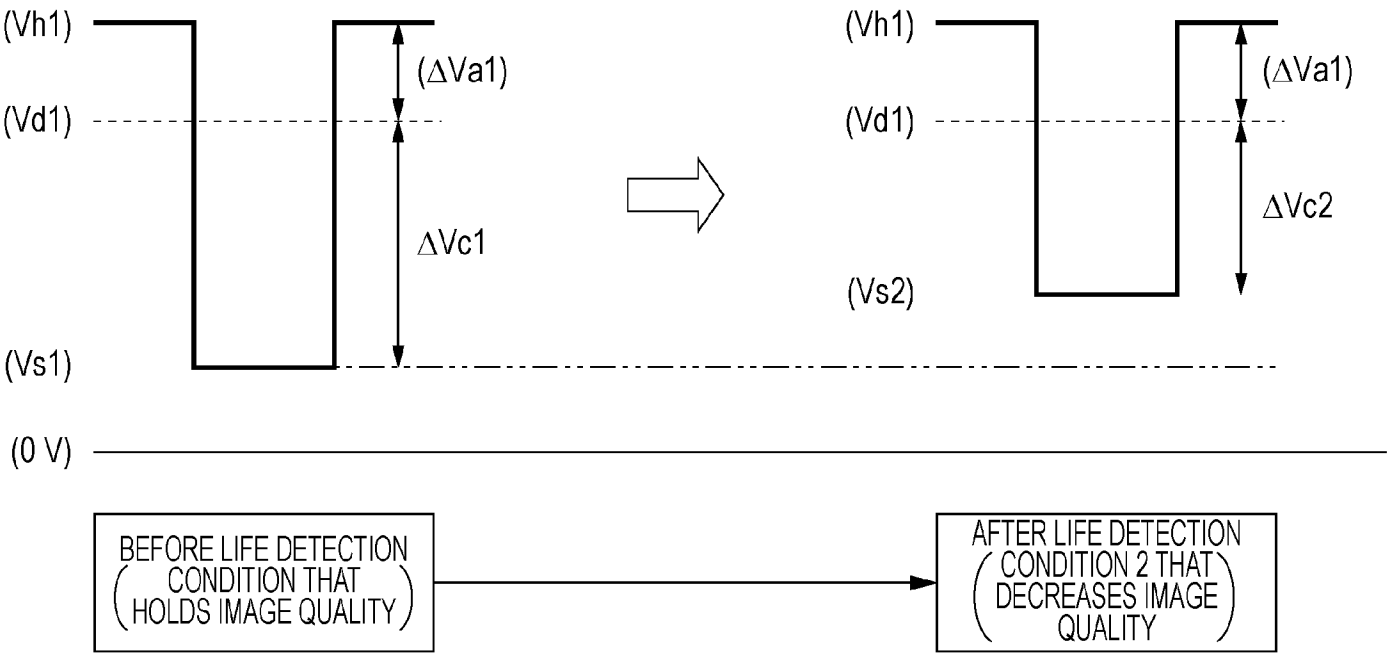
FIG. 6 is an explanatory view showing another example of an imaging condition before the detection of the life of the photoconductor drum and an imaging condition that decreases the image quality, the condition which is changed after the detection of the life.

In this case, the condition that decreases the image quality is, for example, as shown in FIG. 5, a condition (condition 1) that changes only a charge potential (Vh1) in the imaging condition (charge potential Vh, development potential Vd, and latent image potential Vs) that holds the image quality before the detection of the life to a potential (Vh2) which is decreased by a predetermined amount after the detection of the life (causing the charge potential to approach the development potential); and, as shown in FIG. 6, a condition (condition 2) for changing only a latent image potential (Vs1) (actually, output value of exposure) in the imaging condition that holds the image quality before the detection of the life to a potential (Vs2) which is decreased by a predetermined amount after the detection of the life (causing the potential to approach the development potential). The imaging conditions exemplified in FIGS. 5 and 6 are each a condition that the development potential is not changed but is constant before and after the detection of the life. Also, the imaging conditions exemplified in FIGS. 5 and 6 each expect and show a case in which the charge potential Vh, the development potential Vd, and the latent image potential Vs are the potential of "minus polarity."

If an image forming operation is in execution when the imaging condition of the imaging device 2 (Y, M, C, K) including the photoconductor drum 21 at the end of its life is changed in ST15, or if a new image forming operation is started after the imaging condition is changed, the operation of the imaging device 2 (Y, M, C, K) in the image forming operation is controlled under the imaging condition (that decreases the image quality) after the condition is changed by the central controller 6 or in particular the power supply controller 62. Consequently, a color toner image which is formed by the imaging device 2 (Y, M, C, K) during the image forming operation is acquired in a state in which the image quality is intentionally decreased.

That is, if the imaging condition of the relevant imaging device 2 (Y, M, C, K) is changed to the condition 1 exemplified in FIG. 5, in the imaging step, the potential difference between the charge potential and the development potential ($\Delta Va=|Vh-Vd|$) becomes a smaller value ($\Delta Va2<\Delta Va1$) than a proper value ($\Delta Va1$). Hence, the toner likely adheres to (remains at) a background area, and the toner of the same color as the color of the toner image formed by this imaging device 2 (Y, M, C, K) may even adhere to the background area due to defective development. That is, a phenomenon called fogging may occur. Consequently, the recording sheet 9 acquired by this image forming operation is output with defective image quality such that fog is generated, in which the toner with the color of the relevant imaging device 2 (Y, M, C, K) adheres to the background area of the image (non-image area).

Also, if the imaging condition of the relevant imaging device 2 (Y, M, C, K) is changed to the condition 2 exemplified in FIG. 6, the potential difference between the development potential and the latent image potential ($\Delta Vc=|Vd-Vs|$) becomes a smaller value ($\Delta Vc2<\Delta Vc1$) than a proper value ($\Delta Vc1$). Hence, the toner hardly adheres to the latent image portion, and the density of the toner image with the color formed by this imaging device 2 (Y, M, C, K) becomes markedly decreased or the toner image is not visualized as a toner image (in particular, the non-visualized area becomes a blank state in which the toner with the color is not present on the photoconductor drum 21 or the recording sheet 9). That is, the density is markedly decreased. Consequently, the recording sheet 9 acquired in this image forming operation is output in a state with defective image quality such that the toner image with the color of the relevant imaging device 2 (Y, M, C, K) is formed with an insufficient density or with a visually unrecognizable density.

Therefore, a user of the image forming apparatus 1 at this time notices that the image quality of an image (portion) formed by an imaging device 2 (Y, M, C, K) including a process cartridge which should be replaced but not replaced and continuously used since a warning message for urging the replacement of the process cartridge is displayed becomes low and the image is not normally formed. The user intuitively recognizes that it is impossible (wasteful) to further continue the image forming operation. There may be no choice other than replacement of the process cartridge of the imaging device 2 (Y, M, C, K) with the color indicated by the warning message. That is, there is present the fact that the image quality of an image acquired by the image forming operation is decreased to an image quality level exceeding an allowable limit (for example, a state in which an image is hardly recognized). Thus, the replacement of the process cartridge is urged.

Also, in the central controller 6, when the imaging condition of the imaging device 2 (Y, M, C, K) including the photoconductor drum 21 at the end of its life is changed in ST15, thereafter it is continuously detected whether or not the process cartridge of the imaging device 2 (Y, M, C, K) including the photoconductor drum 21 at the end of its life has been replaced or not, with reference to acquisition or non-acquisition of the detection information from the replacement detector 72 (ST16).

If it is detected that the process cartridge of the imaging device 2 (Y, M, C, K) including the photoconductor drum 21 at the end of its life has been replaced in ST16, the central controller 6 provides control to return the imaging condition of the imaging device 2 (Y, M, C, K) including the subject photoconductor drum 21 detected to be at the end of its life to the condition that holds the image quality (condition exemplified at the left sides in FIGS. 5 and 6) (ST17). Accordingly, the imaging operation by the imaging device 2 (Y, M, C, K) after the process cartridge is replaced is executed under the normal imaging condition. In ST16, the life of the photoconductor drum 21 in the process cartridge replaced in ST16 is also detected by the life detector 7 after the mounting by the replacement.

As described above, in the image forming apparatus 1, even if it is detected that the photoconductor drum 21 among the four imaging devices 2 (Y, M, C, K) has reached the end of its life, the image forming operation in execution is not forcedly ended, or the image forming operation started after the detection is not rejected or inhibited from being executed. The image forming operation may be continued even after the detection by a certain degree. A situation in which the image forming operation is stopped or new reception is rejected may not occur and hence the user may no longer have an objection or uncomfortable feeling due to the situation.

Also, even if the user ignores the displaying of the warning message, which urges the replacement of the process cartridge including the relevant photoconductor drum 21, after it is detected that the photoconductor drum 21 of any of the four imaging devices 2 (Y, M, C, K) has reached the end of its life and if the image forming operation is continued, since the image quality of an image formed by the relevant imaging device 2 (Y, M, C, K) is decreased in the image forming operation executed after the value of the predicted film thickness of the photoconductor drum 21 has reached the threshold X since the displaying of the warning message, the user recognizes the necessity of the replacement of the process cartridge due to the decrease in image quality, and the user carries out the replacement work.

If the imaging operation (in particular, image forming operation) by the imaging device 2 (Y, M, C, K) including the photoconductor drum 21 detected to be at the end of its life is continued for a long time (if the photoconductor drum 21 is used for a period over the original life of the photoconductor drum), a phenomenon in which carrier particles in the two-component developer are discharged from the developing device 24 and adhere to the background area of the photoconductor drum 21 (so called bead-carry-out, BCO) or a serious image quality problem as the result of defective charge of the photoconductor drum 21 may occur. In the worst case, after the serious image quality problem occurs, the image forming operation may not be restored to a state available for a normal image forming operation by merely executing the replacement of the process cartridge. Owing to this, a condition (for example, the threshold X) required for determination from when the warning message is displayed to when the imaging condition is changed to the condition that decreases the image quality, is set at a proper value that may reliably urge the replacement of the process cartridge by a safe timing before a serious image quality problem occurs.

Also, the imaging condition that decreases the image quality may be desirably set at a condition that may cause the user to visually recognize a decrease in image quality (not being normal) of a toner image (finally acquired image or background area) formed under the imaging condition.

For example, if the condition 1 exemplified in FIG. 5 is employed as the imaging condition that decreases the image quality, the charge potential (Vh) may be changed to the charge potential (Vh2), which is lower than the charge potential (Vh1) that holds the image quality by about 30 V to about 50 V. In this case, the potential difference (ΔVa) between the charge potential and the development potential is decreased (narrowed) by about 30 V to about 50 V. Also, if the condition 2 exemplified in FIG. 6 is employed as the imaging condition that decreases the image quality, the latent image potential (Vs) may be changed from the same value as the latent image potential (Vs1) to a potential (Vs2) being the same as the development potential (Vd1), with respect to the latent image potential (Vs1) when the image quality is held, or to the potential (Vs2), which is higher (larger) than the development potential (Vd1) by about 10 V. In this case, the potential difference (ΔVc) between the charge potential and the development potential is changed from the potential difference (ΔVc1) to the potential difference (ΔVc2). In the above-described example, the potential difference becomes about 0 in the former case, and the values are inverted in the latter case.

In the first exemplary embodiment, the imaging condition that decreases the image quality employs a condition that does not change the development potential (Vd) as described above. For example, in a case of an image forming apparatus that employs a control method that decreases the charge potential (Vh) and the development potential (Vd) by required amounts as correction with time of the imaging condition, if the development potential (Vd) is changed (to decreased value) as the imaging condition that decreases the image quality after the photoconductor drum 21 (process cartridge) at the end of its life of any of the imaging devices 2 (Y, M, C, K) is replaced, it is required to restore the development potential to be fed to the development roller 24*a* of the developing device 24 after the replacement, from the value (Vd2) to the initial value (Vd1). When restored, the development potential different from the development potential after the correction with time may be applied to the photoconductor drum 21 (process cartridge) that is not yet at the end of its life. There may be a malfunction in which image formation is no longer normally carried out thereafter. Owing to this, to avoid the occurrence of the malfunction, the development potential is not employed (changed) as the imaging condition that decreases the image quality.

Other Exemplary Embodiments

In the first exemplary embodiment, the charge condition represented by the charge potential or the exposure condition represented by the latent image potential included in the imaging condition are changed as the condition that decreases the image quality. However, if possible, a development condition (for example, development potential) or a transfer condition (for example, first transfer voltage) included in the imaging condition may serve as the condition that decreases the image quality.

Also, regarding the condition that decreases the image quality, if the basic configuration relating to the polarity of each potential shown in an upper portion in FIG. 7 is employed, the potential difference may be changed as shown in a lower portion in FIG. 7. The image quality may be decreased in response to each change. The basic configuration employed in the first exemplary embodiment and the potential difference are included in an example shown at the left end in FIG. 7.

Also, in the first exemplary embodiment, the timing at which the imaging condition is changed to the condition that decreases the image quality employs the timing at which the value of the predicted film thickness of the photoconductor drum 21 has reached the threshold X since the displaying of the warning message that urges the replacement of the process cartridge. However, the timing is not limited thereto. For another example, there may be applied a configuration in which the condition is changed to the condition that decreases the image quality at the same timing as the displaying of the warning message, or a configuration in which the condition is changed to the condition that decreases the image quality at the timing at which the life of the photoconductor drum 21 is detected or after a predetermined time elapses since the detection of the life of the photoconductor drum 21. Also, there may be applied a configuration in which the condition is changed to the condition that decreases the image quality after the elapsed time since the displaying of the warning message has reached a predetermined time.

Further, there may be applied, as the image forming apparatus 1, an image forming apparatus of a type including a sheet transport device that transports a recording sheet 9 instead of the intermediate transfer device 3 so that the recording sheet 9 passes through the first transfer positions of the plural imaging devices 2 (Y, M, C, K), or an image forming apparatus of a type including a single imaging device 2 (Y, M, C, K)(without the intermediate transfer device 3 or the like). That is, an image forming device may be applied as long as the image forming apparatus substantially having a drum shape or a belt shape. The structure portion (removably mounted unit) that is removably mounted on the housing 10 of the apparatus body may be formed of only the photoconductor drum 21. Also, other components that are assembled with the photoconductor drum 21 are not limited to the configuration (charging device) exemplified in the first exemplary embodiment. The component may be replaced with another component and still another component may be further added to the charging device 22.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

at least one imaging device including at least a photoconductor, a charging device, an exposure device, a developing device, and a transfer device;

a detector that detects that the photoconductor of the at least one imaging device has reached an end of a life of the photoconductor; and a controller that controls the at least one imaging device under an imaging condition including a charge condition, an exposure condition, a development condition, and a transfer condition, wherein, after the controller acquires detection information of the detector, the controller controls the at least one imaging device by changing the imaging condition to a condition that decreases an image quality.

2. The image forming apparatus according to claim 1, further comprising:

a warning unit that displays a warning that urges replacement of the photoconductor after the detection information of the detector is acquired, wherein the controller changes the imaging condition to the condition that decreases the image quality at a timing when an elapsed time since the warning of the warning unit is displayed passes a predetermined time.

3. The image forming apparatus according to claim 1, wherein the at least one imaging device comprises a plurality of imaging devices, wherein the detector individually detects that each of a plurality of the photoconductors in the plurality of imaging devices has reached the end of a life of the photoconductor, wherein, after the controller acquires the detection information of the detector, the controller controls the imaging device including the photoconductor being the detection subject by changing the imaging condition of the imaging device to the condition that decreases the image quality.

4. The image forming apparatus according to claim 1, wherein the controller changes the charge condition or the exposure condition included in the imaging condition to the condition that decreases the image quality.

* * * * *